United States Patent [19]

Carlson

[11] 4,113,034

[45] Sep. 12, 1978

[54] UNIAXIAL VARIABLE VIBRATORY FORCE GENERATOR

[75] Inventor: Roger L. Carlson, Fridley, Minn.

[73] Assignee: Raygo, Inc., Minneapolis, Minn.

[21] Appl. No.: 807,833

[22] Filed: Jun. 20, 1977

[51] Int. Cl.[2] ..... E02D 7/18

[52] U.S. Cl. ..... 173/49; 74/61

[58] Field of Search ..... 173/49; 175/55; 74/61, 74/87, 325

[56] References Cited

U.S. PATENT DOCUMENTS

| | | | |
|---|---|---|---|
| 3,093,007 | 6/1973 | Aebersold | 74/325 |
| 3,433,311 | 3/1969 | Lebelle | 173/49 |
| 3,502,160 | 3/1970 | Herz | 173/49 |
| 3,572,641 | 3/1971 | Peterson et al. | 74/61 |
| 3,722,302 | 3/1973 | Piatkowski et al. | 74/61 |
| 3,828,864 | 8/1974 | Haverkamp et al. | 173/49 |
| 3,837,231 | 9/1974 | Holmlund | 74/61 |

*Primary Examiner*—Robert A. Hafer

*Attorney, Agent, or Firm*—Ira Milton Jones & Associates

[57] ABSTRACT

A uniaxial vibratory force generator especially adapted for use as a pile driver, which comprises a rigid frame structure having a power actuated clamp at its bottom by which the frame structure grips a pile, and attachment means at its top by which the frame structure is suspended from above. In the frame structure are two superimposed pairs of counter-rotating eccentric weights, each of which is driven by a hydraulic motor. Simultaneous rotation of all of the eccentric weights produces a uniaxial force of a magnitude determined by the phase relationship between the superimposed pairs of eccentric weights. An adjustable coupling between the superimposed pairs of eccentric weights enables that phase relationship to be selectively varied. The coupling is in the form of two meshing gears, one of which is fixed to the shaft of one of the motors driving the eccentric weights of one pair thereof and the other of which has a helically splined connection with a sleeve that is axially splined to the shaft of the adjacent motor of the other pair of eccentric weights. Axial adjustment of the sleeve with respect to the gear mounted thereon thus changes the angular relationship of that gear with respect to the shaft to which the sleeve is splined and, in so doing, effects a corresponding adjustment of the phase relationship between the eccentric weights of the two pairs thereof.

4 Claims, 9 Drawing Figures

Fig. 1
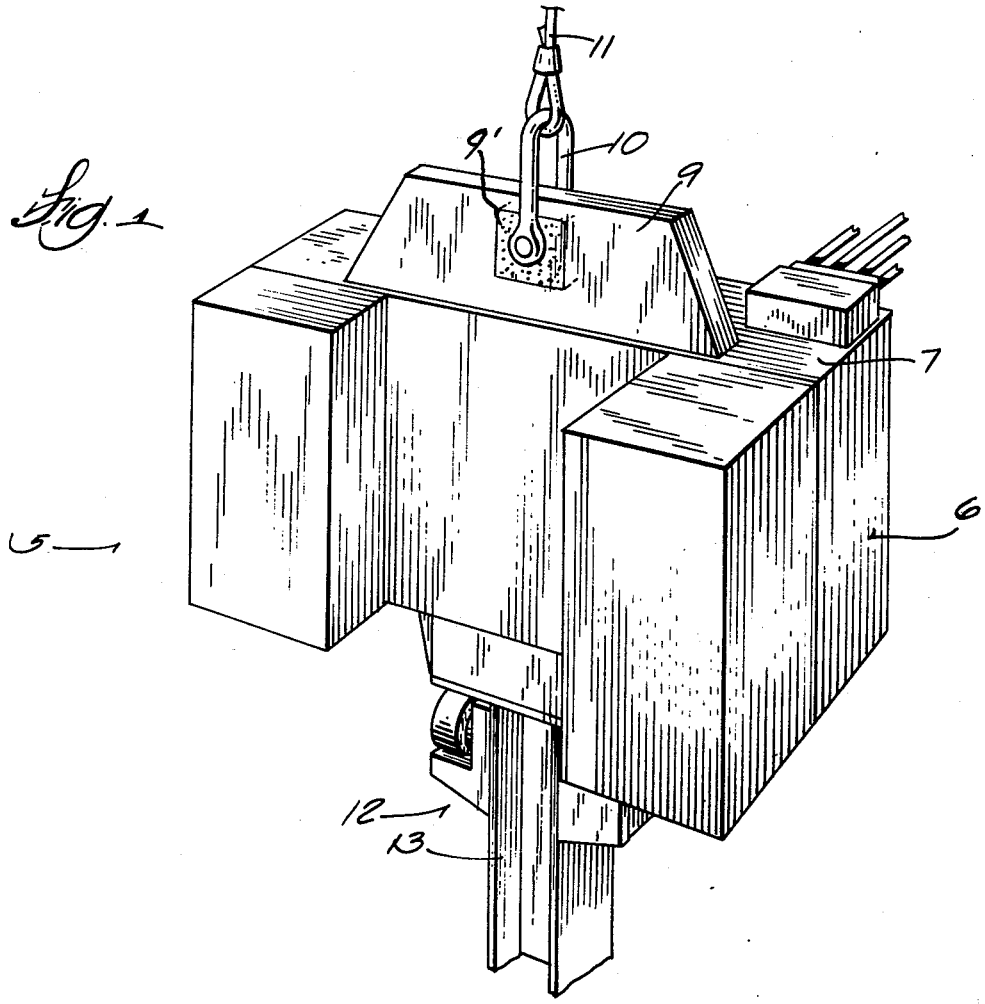
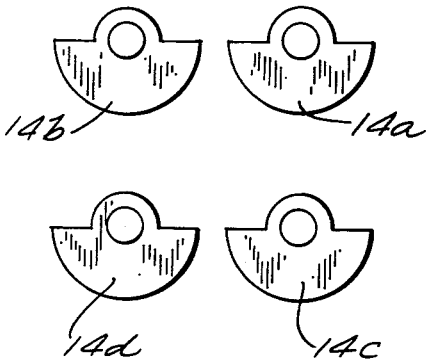
Fig. 7
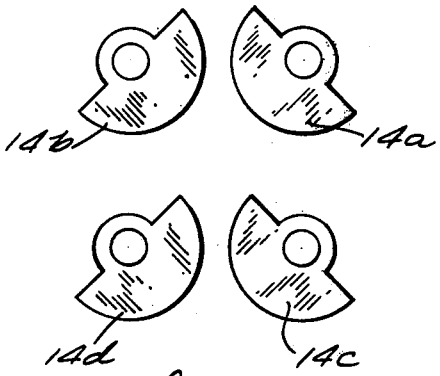
Fig. 8

11
10
9'
9
4
3
11
19
21b
14b
14a
21a
23
20f
15
15
20e
24
19
38
20h
14d
14c
20g
37
36
15
15
34
31
21d
22
33
4
3
12
13

UNIAXIAL VARIABLE VIBRATORY FORCE GENERATOR

This invention relates to vibratory force generators of the type in which two or more pairs or sets of counter-rotating eccentric weights collectively produce a uniaxial vibratory force. The invention is therefore well adapted for use as a pile driver or vibrodriver, as such pile drivers are often called.

The state of the art to which the invention pertains is most conspicuously identified by the LeBelle U.S. Pat. Nos. 3,433,311 and 3,564,932, and the Herz U.S. Pat. No. 3,502,160. Of these, the LeBelle '932 patent is most pertinent.

As in the LeBelle '932 patent, the vibratory force generator of this invention has provision for selectively varying the net force delivered by the generator, but where the phase-shifting instrumentalities of the LeBelle patent are extremely complicated, that of the present invention is the epitome of simplicity. This is in keeping with the primary purpose and object of this invention, which is to provide an improved phase shifting coupling between at least two pairs of counter-rotating eccentric weights of a vibrodriver, to the end that an operator stationed on the ground can instantaneously and safely vary the net vibratory force delivered by a crane-suspended vibrodriver without changing the speed of rotation of the eccentric weights or in anywise interfering with the operation of the machine.

Another object of the invention is the attainment of a variable vibratory force generator that is sufficiently rugged to withstand the rough conditions to which pile drivers are subjected, and that is simple in design and construction. To achieve the aforesaid objectives, the invention resides in and comprises a vibratory force generator having a rigid frame structure through which the generated vibratory force may be uniaxially transmitted to a part which is to be subjected to that force, wherein the vibratory force is produced by rotation of a plurality of pairs of rotary eccentric weights rotatably mounted in the rigid frame structure with said pairs at spaced locations on the axis along which the vibratory force is to be transmitted, the weights of each pair thereof being constrained to counter-rotation about fixed axes that lie in a plane normal to said axis in such phase relationship that the direction of the vibratory force resulting from their counter-rotation, is confined to said axis, wherein power means drivingly connected with all the rotary eccentric weights simultaneously imparts rotation thereto, and wherein an adjustable coupling between adjacent pairs of counter-rotating eccentric weights enables the phase relationship between said pairs of eccentric weights to be varied from an in-phase relationship for the production of maximum force, to an infinite number of less than in-phase relationships for selected reduction in the magnitude of the generated vibratory force; the improvement by which said coupling can be adjusted from a location remote from the vibratory force generator and without altering the RPM of the eccentric weights or otherwise interfering with them and which comprises: first and second parallel shafts, one having a fixed driving relationship with the rotary eccentric weights of one of said adjacent pairs thereof and the other having a fixed driving relationship with the rotary eccentric weights of the other one of said adjacent pairs thereof; first and second meshing gears, the first gear being on and fixed against relative rotation with respect to said first shaft and the second gear being on but rotatable with respect to said second shaft; means for securing said second gear and said second shaft against relative rotation from a selected angular relationship, the selection of which determines the phase relationship of said adjacent pairs of rotary eccentric weights, said last named means comprising: a sleeve axially slidably but non-rotatably mounted on said second shaft, and means forming a helical splined driving connection between said sleeve and said second gear so that shifting said sleeve axially along the second shaft and with respect to said second gear adjusts the phase relationship between said adjacent pairs of rotary eccentric weights.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof and in which:

FIG. 1 is a perspective view of the vibratory force generator or vibrodriver of this invention in use as a pile driver;

FIGS. 7 and 8 illustrate the superimposed pairs or sets of counter-rotating eccentric weights in different phase relationships.

Figure 2:
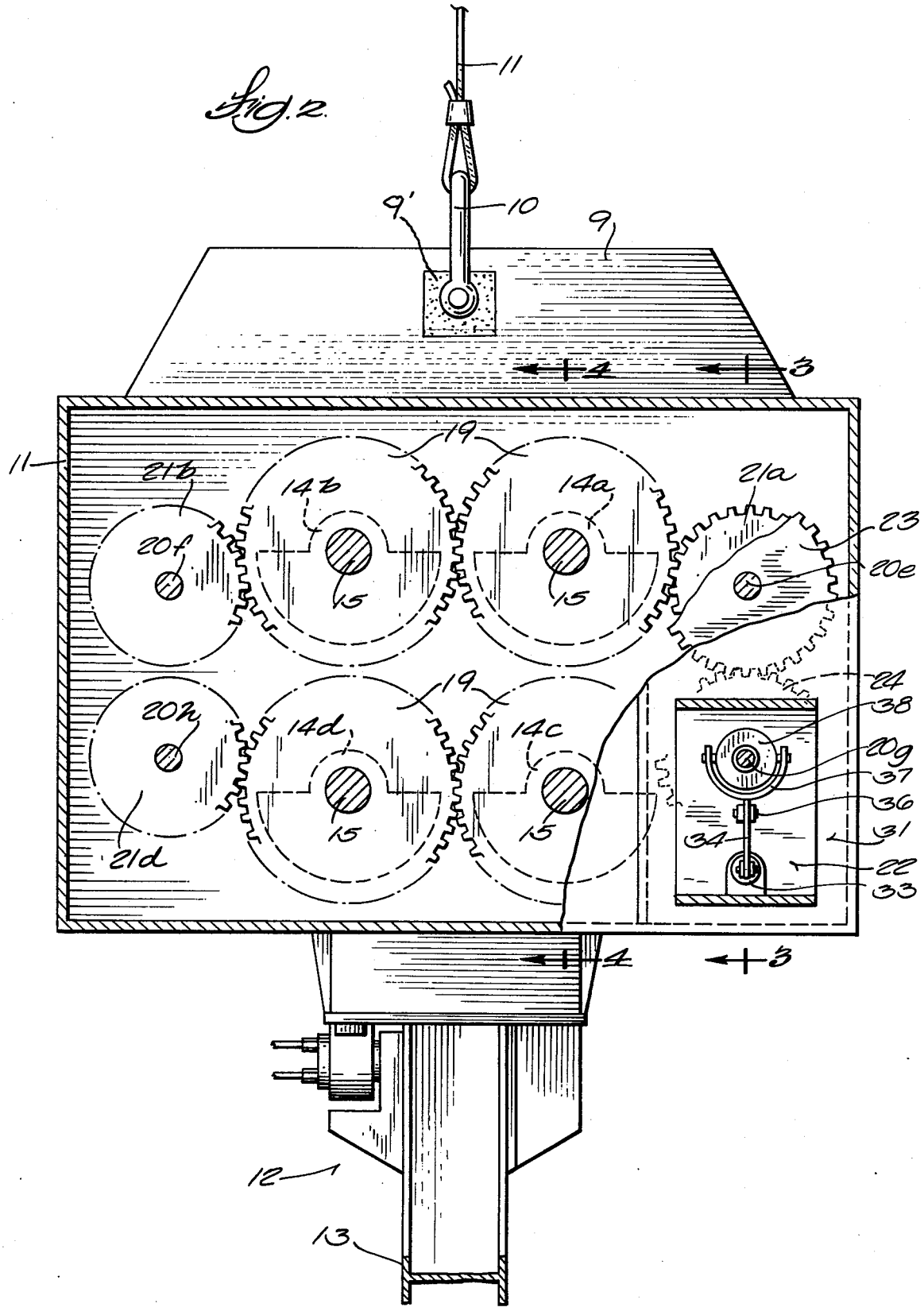
FIG. 2 is a front view of the vibrodriver with parts broken away and in section.

Referring to the accompanying drawings, the numeral 5 designates generally the vibratory force generator of this invention which — being intended for use in pile driving and extraction — can be called a vibrodriver. The entire machine is housed in a rugged, rigid box-like structure 6 that has top and bottom walls 7 and 8, respectively. A beam 9 extending across the top wall and attached to a clevis 10 through a suitable vibration isolation means diagrammatically illustrated at 9', enables the machine to be suspended from the hoisting cable 11 of a crane in a manner protecting the crane during extraction.

At the bottom of the housing structure is a hydraulically actuated vise or clamp 12 by which the vibrodriver is securable to a pile 13 to be driven into or withdrawn from the ground by the vibratory force produced by the machine, depending upon whether the cable 11 is slack or under tension. In a sense, therefore, during use of the machine, the housing structure and the pile become one entity — at least to the extent that vibratory force imparted to the housing structure will be transmitted to the pile.

Figure 4:
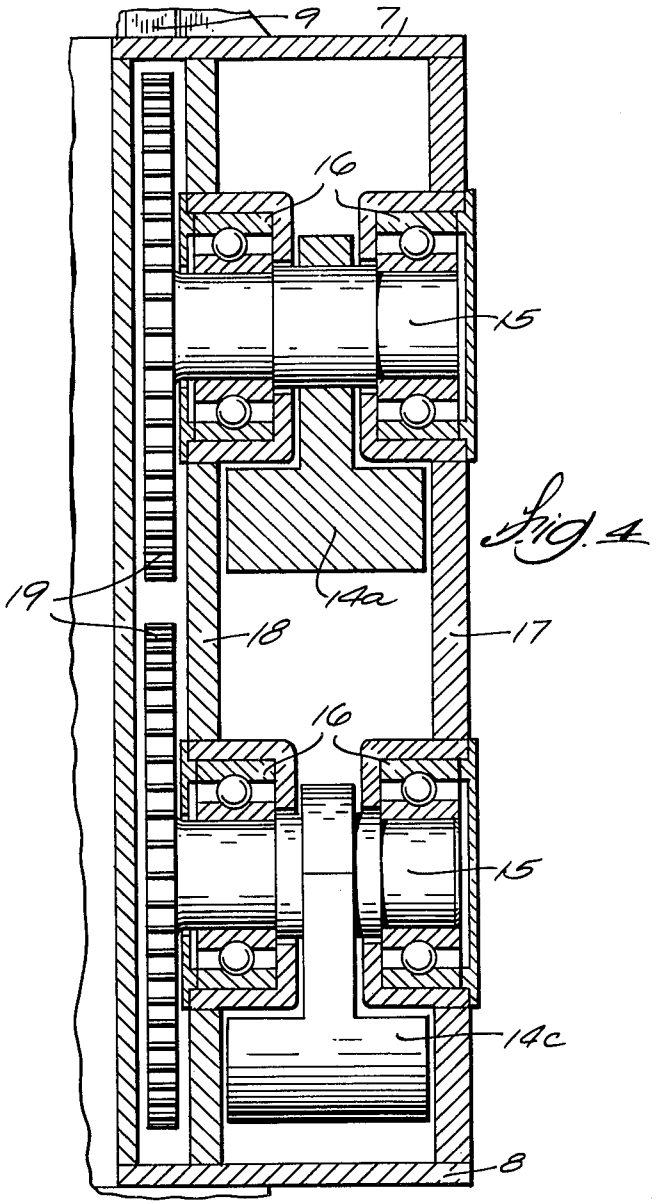
FIG. 4 is a vertical sectional view through FIG. 2 on the plane of the line 4—4.

That vibratory force is produced by two superimposed pairs of counter-rotating eccentric weights, the upper pair being designated by the numerals 14*a* and 14*b*, the lower pair 14*c* and 14*d*. As best seen in FIG. 4, each of the rotary eccentric weights is fixed to a shaft 15 that is journalled in coaxial bearings 16 set in a heavy back wall 17 and an equally heavy intermediate wall 18. These walls form part of the housing structure 6. The shafts 15 project through the intermediate wall 18 and have gears 19 fixed to their projecting ends. Each of these gears is thus fixed with respect to one of the eccentric weights; and since the gears of each pair of eccentric weights are in mesh, the weights of each pair rotate in opposite directions.

The four eccentric weights 14*a* through 14*d* are individually driven by hydraulic motors 20*a*, 20*b* 20*c* and 20*d*, respectively, the driving connections between the weights and their respective motors being provided by gears 21*a*, 21*b*, 21*c* and 21*d* fixed to the motor shafts 20*e*, 20*f*, 20*g* and 20*h* and meshing with the gears 19.

As seen in FIG. 2, the eccentric weights of each pair thereof are symmetrically disposed with respect to a vertical axis that passes through the center of the pile gripping vise and the point of attachment of the machine to the cable of the crane. Consequently, the vibratory force that results from the simultaneous rotation of the four eccentric weights is uniaxial and along the aforesaid vertical axis.

The magnitude of the force generated by rotation of the eccentric weights depends upon the phase relationship between the eccentric weights of the two pairs. An "in phase" relationship as shown in FIG. 7 produces the maximum force output; a 180° out-of-phase relationship would result in zero force output; and, of course, between these extremes practically any desired magnitude of force can be achieved by proper adjustment of the phase relationship between the two pairs of eccentric weights. To illustrate, with the eccentric weights of one pair lagging behind those of the other pair by 90° as shown in FIG. 8, the net force delivered by the machine is 0.707 times the maximum.

Figure 3:
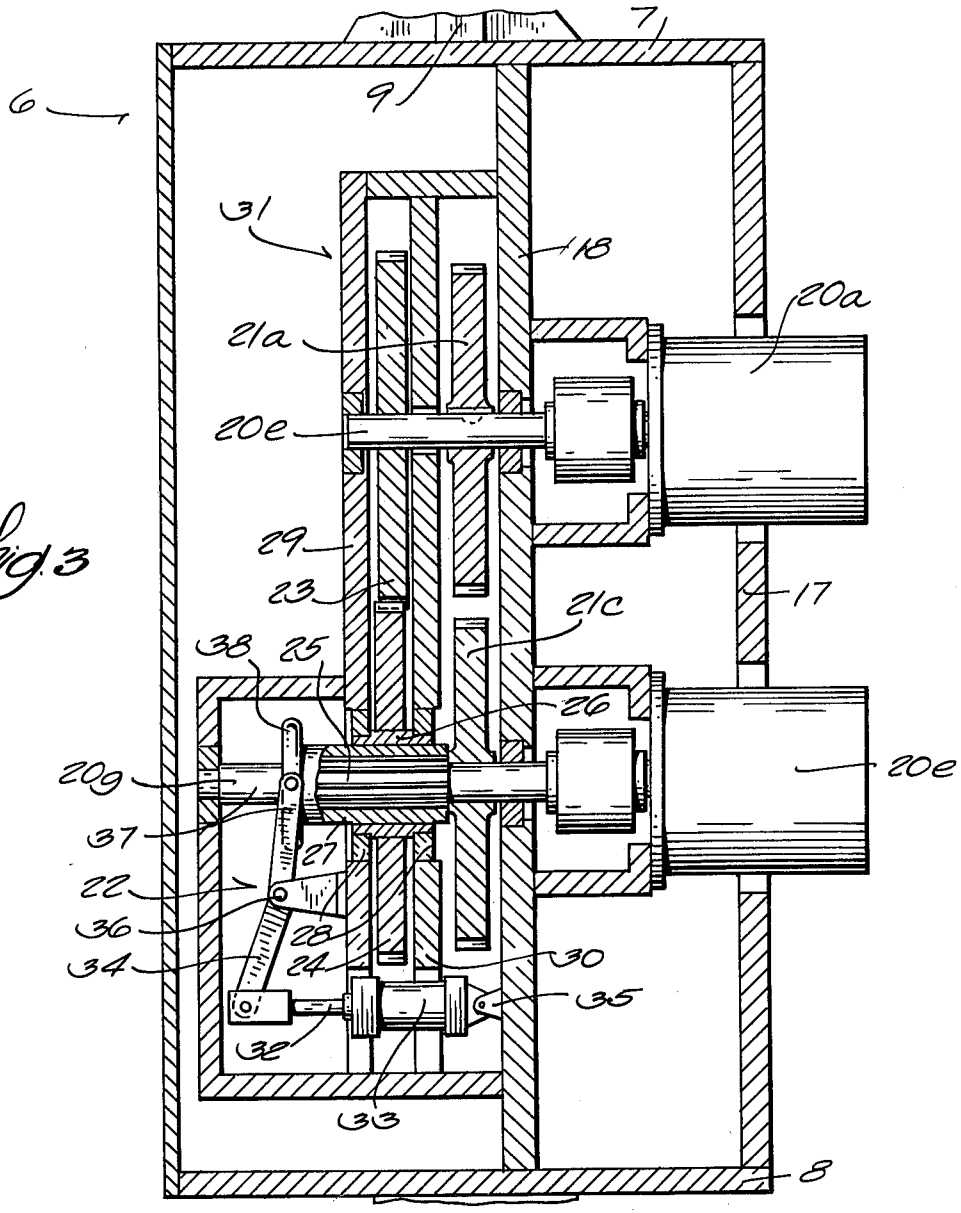
FIG. 3 is a vertical sectional view through FIG. 2 on the plane of the line 3—3.
Figure 5:
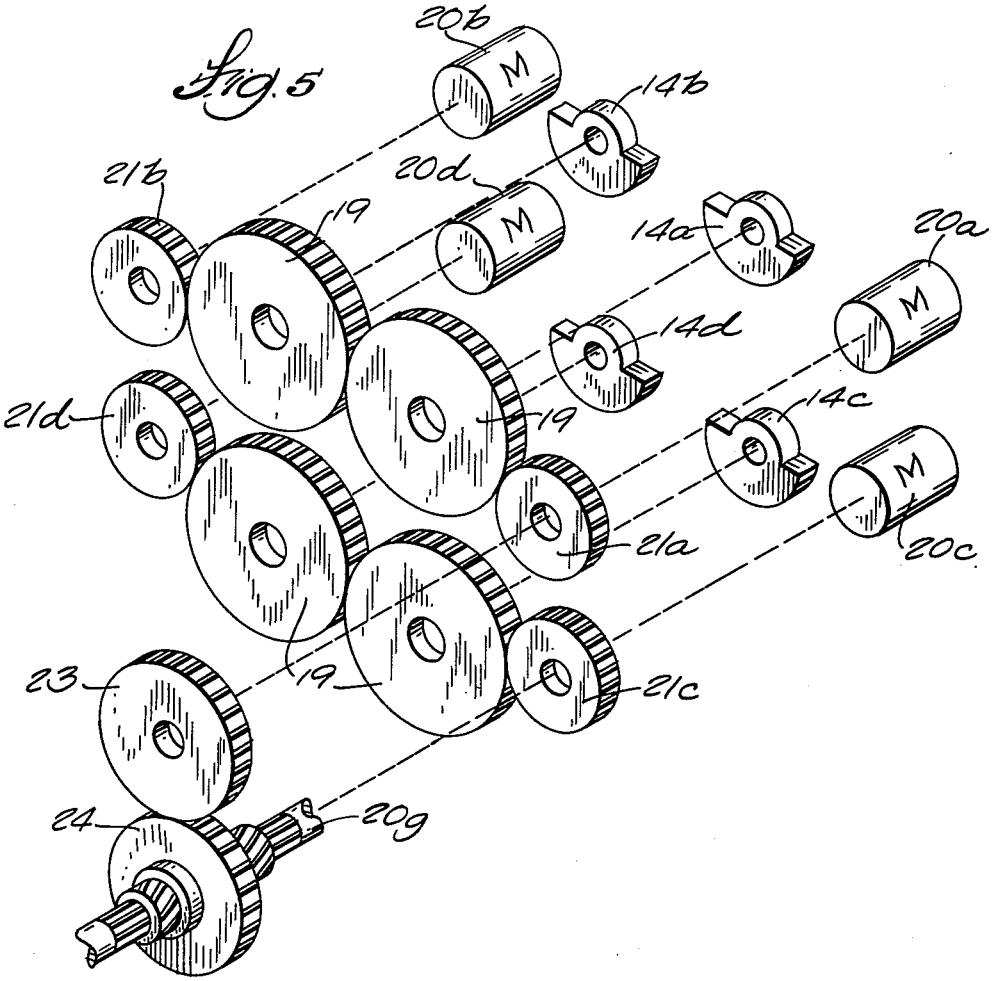
FIG. 5 is an exploded perspective view of the operating elements of the vibrodriver.
Figure 6:
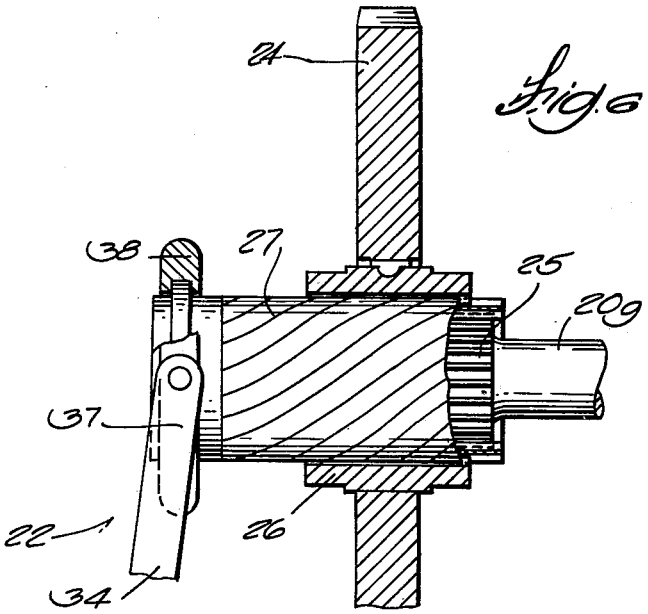
FIG. 6 is a detail sectional view of the phase shifting coupling by which the phase relationship between the superimposed pairs of counter-rotating eccentric weights can be adjusted, said view being taken on the plane of the line 3—3 in FIG. 2, but at an enlarged scale.

While, as indicated hereinbefore, adjustment of the phase relationship between multiple sets of eccentric weights in not unprecedented, in the past the means employed to achieve that adjustment has been extremely complicated. It is elimination of that disadvantage of prior vibrodrivers that constitutes the primary objective of this invention. To that end, a simple mechanism capable of mechanically converting axial motion into rotary motion, provides a phase-shifting coupling between the upper and lower pairs of eccentric weights. That mechanism, indicated generally by the numeral 22, is illustrated in FIGS.3 and 6. It comprises a pair of meshing gears 23 and 24, the former fixed to the shaft 20*e* of the hydraulic motor 20*a* and the latter mounted on a sleeve 25 which is slidably splined to the shaft 20*g* of the hydraulic motor 20*c*. By virtue of its splined connection with that motor shaft, the sleeve is constrained to rotate in unison with the motor 20*c*, but ca be moved axially with respect to the shaft.

To convert axial motion of the sleeve into rotation of the gear 24 — which rotation alters the angular relationship between the motor shaft 20*g* and the meshing gears 23 and 24 and thus achieves adjustment of the phase relationship between the upper and lower pairs of counter-rotating eccentric weights — the hub 26 of the gear 24 is connected with the sleeve by helical flutes or splines 27 or by a conventional ball drive.

It is, of course, understood that the hub 26 is held against axial displacement. That is done by appropriately confining the bearings 28 in which the hub is journalled, in spaced parallel upright walls 29 and 30 of a frame structure 31 that is located in front of the heretofore identified intermediate wall 18.

To shift the sleeve 25 in or out, the piston rod 32 of a double-acting hydraulic cylinder 33 is connected with the sleeve by an intermedially pivoted lever 34. A pivotal connection 35 between the closed end of the cylinder and the intermediate wall 18 provides an anchor for the cylinder, yet accommodates up and down swinging motion of its open end as the point of connection between the piston rod 32 and the lower end of the lever 34 rocks about the pivot 36 by which the lever is supported from the wall 29.

The upper end of the lever 34 is connected with the outer end of the sleeve by a fork 37 and a spanner ring 38.

Figure 9:
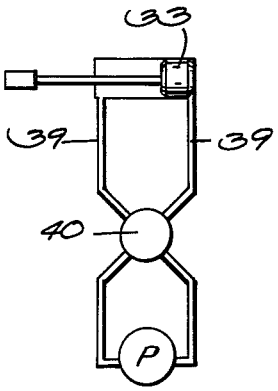
FIG. 9 diagrammatically illustrates the remotely actuatable control for the phase shifting coupling.

As diagrammatically illustrated in FIG. 9, the cylinder 33 is connected by flexible hoses 39 with a source of fluid pressure through a control valve 40. Hence, by merely adjusting the valve 40 — which can be located wherever convenient — actuation of the cylinder can be effected to selectively adjust the phase relationship between the upper and lower pairs of counter-rotating eccentric weights.

Obviously, of course, the hydraulically actuated pile gripping vise 12 is connectable with a fluid pressure source in a manner allowing the vise to be opened and closed by actuation of a suitable conveniently located control valve.

Those skilled in the art will appreciate that the invention can be embodied in forms other than as herein disclosed for purposes of illustration.

The invention is defined by the following claims:

I claim:

1. In a vibratory force generator having a rigid frame structure through which the generated vibratory force may be uniaxially transmitted to a part which is to be subjected to said force, wherein the vibratory force is produced by rotation of a plurality of pairs of rotary eccentric weights rotatably mounted in said rigid frame structure with said pairs at spaced locations on the axis along which the vibratory force is to be transmitted, the weights of each pair thereof being constrained to counter-rotation about fixed axes that lie in a plane normal to said axis in such phase relationship that the direction of the vibratory force resulting from their counter-rotation, is confined to said axis, wherein power means drivingly connected with all of the rotary eccentric weights simultaneously imparts rotation thereto, and wherein an adjustable coupling between adjacent pairs of counter-rotating eccentric weights enables the phase relationship between said pairs of eccentric weights to be varied from an in-phase relationship for the production of maximum force, to an infinite number of less than in-phase relationships for selected reduction in the magnitude of the generated vibratory force; the improvement by which said coupling can be adjusted from a location remote from the vibratory force generator and without altering the RPM of the eccentric weights or otherwise interfering with them and which comprises:

A. first and second parallel shafts, one having a fixed driving relationship with the rotary eccentric weights of only one of said adjacent pairs thereof and the other having a fixed driving relationship with the rotary eccentric weights of only the other one of said adjacent pairs thereof;

B. first and second meshing gears, the first gear being on and fixed against relative rotation with respect to said first shaft and the second gear being on but rotatable with respect to said second shaft;

C. means for securing said second gear and said second shaft against relative rotation from a selected angular relationship, the selection of which determines the phase relationship of said adjacent pairs of rotary eccentric weights, said last means comprising (1) a sleeve axially slidably but non-rotatably mounted on said second shaft, and (2) means forming a helical splined driving connection between said sleeve and said second gear so that shifting said sleeve axially along the second shaft and with respect to said second gear adjusts the phase relationship between said adjacent pairs of rotary eccentric weights.

2. The improvement in a vibratory force generator defined by claim 1, further characterized by:

A. fluid pressure responsive motion producing means arranged to react between said sleeve and an adjacent part of the rigid frame structure; and B. means for so connecting said fluid pressure responsive motion producing means with a source of fluid pressure as to selectively effect axial movement of said sleeve in one direction or the other.

3. The improvement in a vibratory force generator defined by claim 1, wherein said power means comprises a separate hydraulic motor for each of said rotary eccentric weights, each motor having a drive shaft drivingly connected with its respective eccentric weight by meshing gears, and wherein the drive shaft of one of said hydraulic motors in said second shaft on which said sleeve is mounted.

4. The improvement in a vibratory force generator defined by claim 3, wherein said fluid pressure responsive means comprises a double acting hydraulic cylinder.

* * * * *